US012251603B2

(12) United States Patent
Parent et al.

(10) Patent No.: US 12,251,603 B2
(45) Date of Patent: Mar. 18, 2025

(54) BAR TAPPING TOOL

(71) Applicants: James Parent, Mount Pleasant, MI (US); Brett Wargo, Bonney Lake, WA (US); Carrie Spender, Vancouver, WA (US)

(72) Inventors: James Parent, Mount Pleasant, MI (US); Brett Wargo, Bonney Lake, WA (US); Carrie Spender, Vancouver, WA (US)

( * ) Notice: Subject to any disclaimer, the term of this patent is extended or adjusted under 35 U.S.C. 154(b) by 34 days.

(21) Appl. No.: 18/207,778

(22) Filed: Jun. 9, 2023

(65) Prior Publication Data

US 2023/0398394 A1 Dec. 14, 2023

Related U.S. Application Data

(60) Provisional application No. 63/351,874, filed on Jun. 14, 2022.

(51) Int. Cl.
*A63B 3/00* (2006.01)
*A63B 71/06* (2006.01)

(52) U.S. Cl.
CPC ..... *A63B 3/00* (2013.01); *A63B 2071/0655* (2013.01)

(58) Field of Classification Search
CPC ..... A63B 3/00; A63B 2071/0655
See application file for complete search history.

(56) References Cited

U.S. PATENT DOCUMENTS 3,379,168 A * 4/1968 Bosworth ..... A63B 47/04 401/52
3,679,203 A * 7/1972 Grana ..... A63B 21/00047 482/142
3,831,941 A * 8/1974 Pease ..... A63B 71/0054 267/116
3,874,375 A * 4/1975 Penner ..... A63B 7/00 606/241
3,958,801 A * 5/1976 Correa ..... A63B 71/0054 482/41
4,722,523 A * 2/1988 Yang ..... A63B 17/04 482/40
6,435,990 B1 * 8/2002 Bradley ..... A63B 69/0002 473/422
8,197,391 B2 * 6/2012 Ruschell ..... A63B 71/0054 482/41
2011/0098124 A1 * 4/2011 Willis ..... A63B 69/3667 473/409
2019/0059568 A1 * 2/2019 Orlando ..... A46B 5/0041

* cited by examiner

*Primary Examiner* — Andrew S Lo
(74) *Attorney, Agent, or Firm* — Dale J. Ream

(57) ABSTRACT

A bar tapping tool for use during a tap swing drill includes a plurality of bristles adjacent one another and extending horizontally so as to signal when the gymnast should begin her bodily shape change while keeping a safe distance from lower bar. The bar tapping tool has bristles of different lengths extending horizontally so that an athlete swinging on the upper bar can at first swing at a farther distance away from the lower bar and then later, when more experienced, swing at a closer distance away from the lower bar.

17 Claims, 4 Drawing Sheets

BAR TAPPING TOOL

REFERENCE TO RELATED APPLICATIONS

This application claims the benefit of provisional patent application 63/351,874 filed Jun. 14, 2022, titled Bar Tapping Tool, the entirety of which is incorporated herein by reference.

BACKGROUND OF THE INVENTION

This invention relates generally to gymnast training equipment and, more particularly, to a "tap swing" or "bar tapping" tool.

Gymnastics is an elegant and physically demanding sport that requires strength, balance, flexibility, coordination, and discipline. Training young gymnasts takes many years of dedicated training, often beginning at a young age to develop a strong foundation and maximize potential and then continuing on to the teenage and even college years. Classes are routinely taught by experienced gymnasts and include a multiplicity of repetitious drills to build strength and technique. A focus on developing physical endurance, consistency, and technique is important as is developing psychological confidence, determination, and self-worth. At the youngest ages, the focus may be on body awareness, basic skills, body position, and generally having fun and demonstrating progression. Basic gymnastics skills include roles, handstands, cartwheels, and bridges. These are building blocks for more complex routines in the future. A young gymnasts must learn how to properly address and grasp a bar, how to spin or rotate about the bar, and how to bend or pike one's legs and back in the process. As the gymnast progresses, the gymnast is introduced to more sophisticated equipment and techniques. Body position and timing become even more critical.

After years of training, a young gymnast may begin training on the uneven bars, which includes an upper horizontal bar and a lower horizontal bar positioned in succession. A spin or rotation on the upper bar can only be successful when the gymnast bends her body at the waist sufficiently to prevent her feet or ankles from striking the lower bar. Teaching a young gymnast to bend properly and just the right amount can be a challenge and even frightening.

Therefore, it would be desirable to have a bar tapping tool that may be attached to a lower bar of an uneven bars apparatus and which has a plurality of bristles that extend away from the lower bar so as to provide a tactile indicator to a gymnast swinging on the upper bar. Further, it would be desirable to have a bar tapping tool that has on one side a plurality of bristles each having a longer length and has on the opposing side a plurality of bristles each having a shorter length. The idea, of course, is for an athlete engaging in a "tap swing" to keep a safe distance from lower bar and signal when the athlete should begin their shape change and learn how to stretch out their swing as much as possible.

SUMMARY OF THE INVENTION

A bar tapping tool for use during a tap swing drill according to the present invention includes a plurality of bristles adjacent one another and extending horizontally away from a padded body so as to signal when the gymnast should begin her bodily shape change while keeping a safe distance from lower bar. The bar tapping tool has bristles of different lengths extending horizontally away from the padded body so that an athlete swinging on the upper bar can at first swing at a farther distance away from the lower bar and then later, when more experienced, swing at a closer distance away from the lower bar. Eventually, the body and bristles may be completely removed from the lower bar.

Therefore, a general object of this invention is to provide a bar tapping tool for use during a tap swing drill having a plurality of bristles adjacent one another and extending horizontally so as to signal when the gymnast should begin her bodily shape change while keeping a safe distance from lower bar.

Another object of this invention is to provide a bar tapping tool, as aforesaid, having bristles of different lengths extending horizontally so that an athlete swinging on the upper bar can at first swing at a farther distance away from the lower bar and then later, when more experienced, swing at a closer distance away from the lower bar.

Still another object of this invention is to provide a bar tapping tool, as aforesaid, having a body situated between the bristles of longer length and bristles of shorter length and that is configured for releasable and frictional coupling to a lower bar of an uneven bars apparatus.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
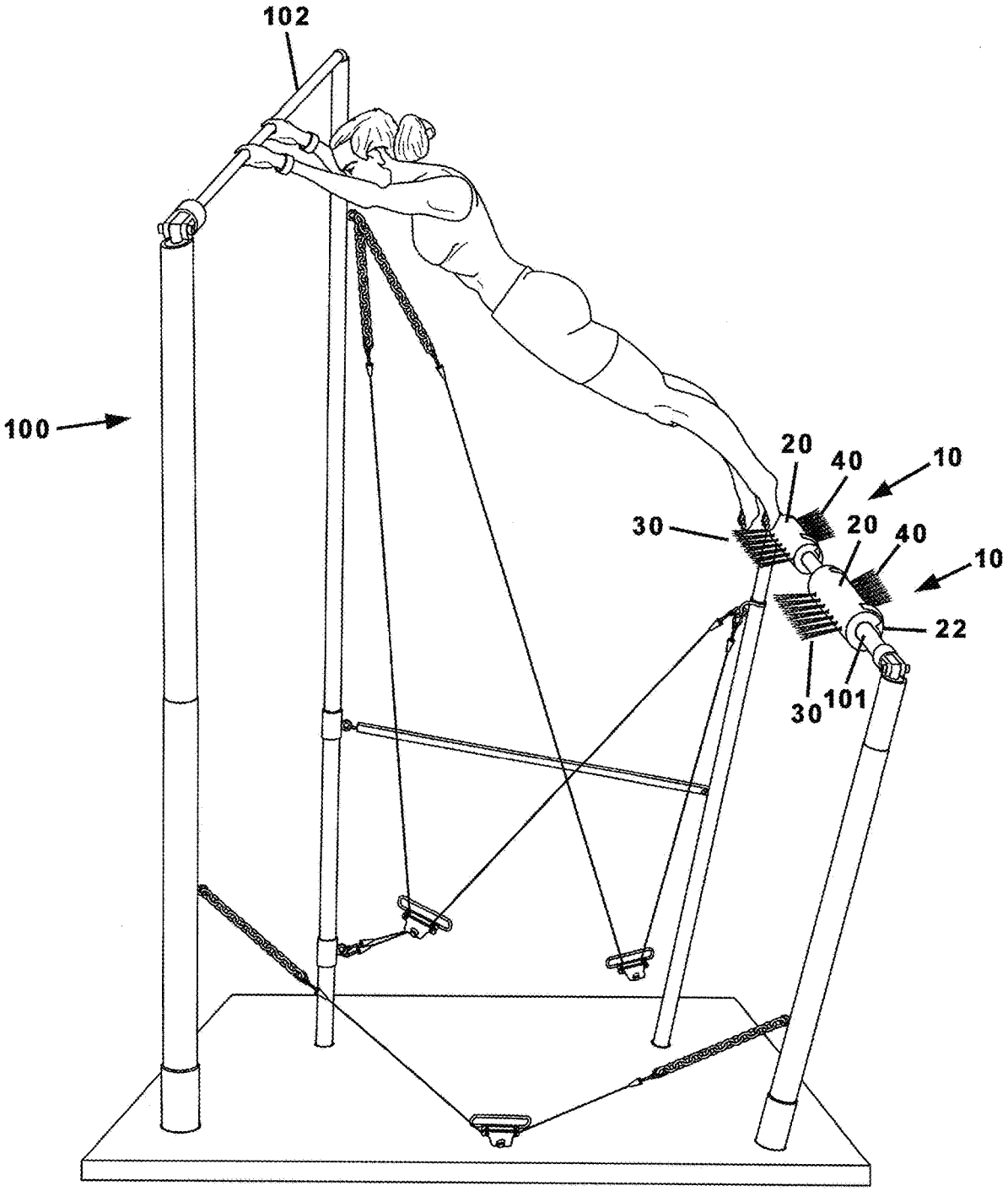
FIG. 1A is a perspective view of a bar tapping tool according to a preferred embodiment of the present invention, illustrated with the bar tapping tool in a first configuration having the long bristles facing inwardly in a direction facing the upper bar.
Figure 1B:
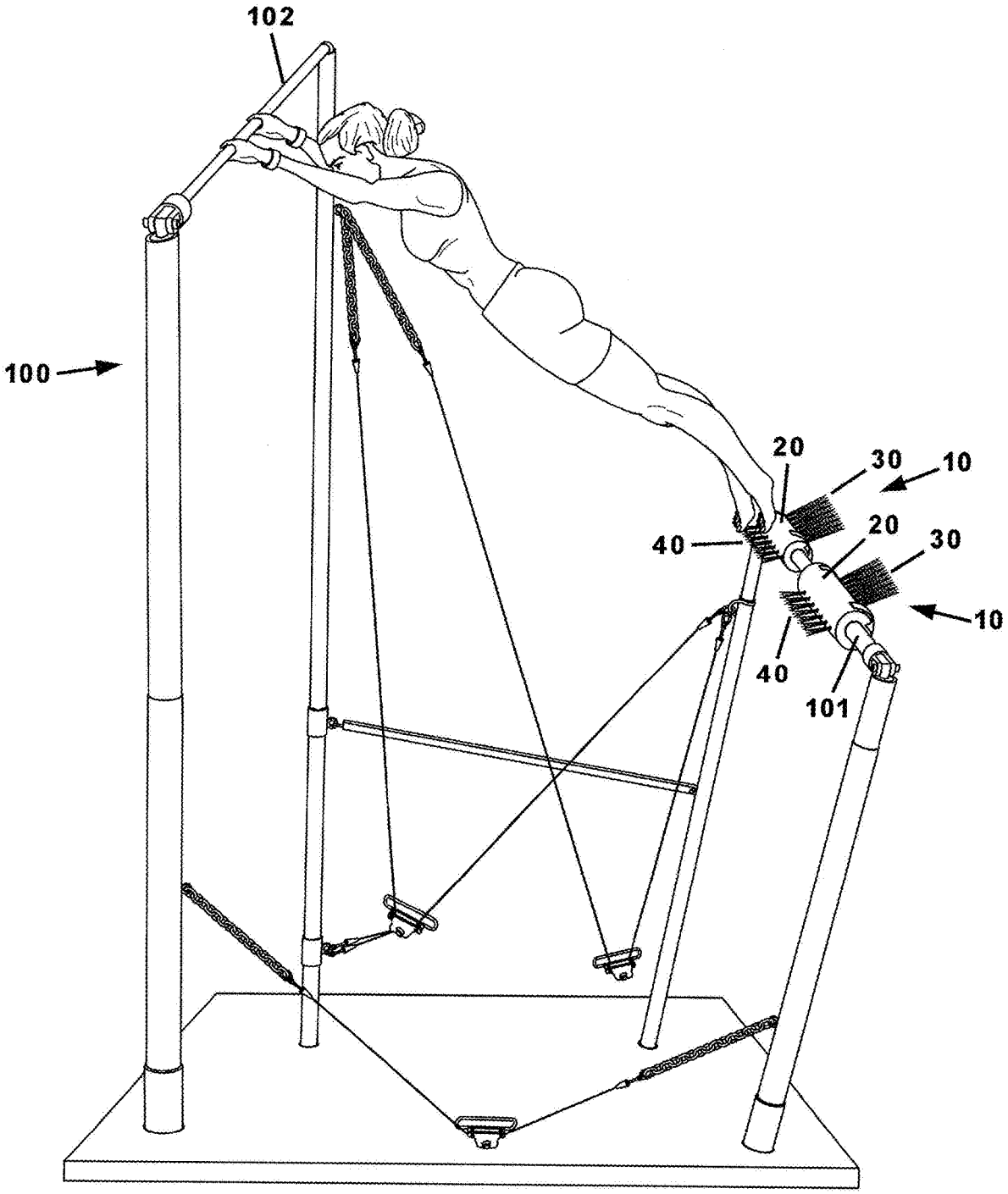
FIG. 1B is another perspective view of the bar tapping tool, illustrated with the bar tapping tool in a second configuration having the short bristles facing inwardly toward the upper bar.
Figure 2A:
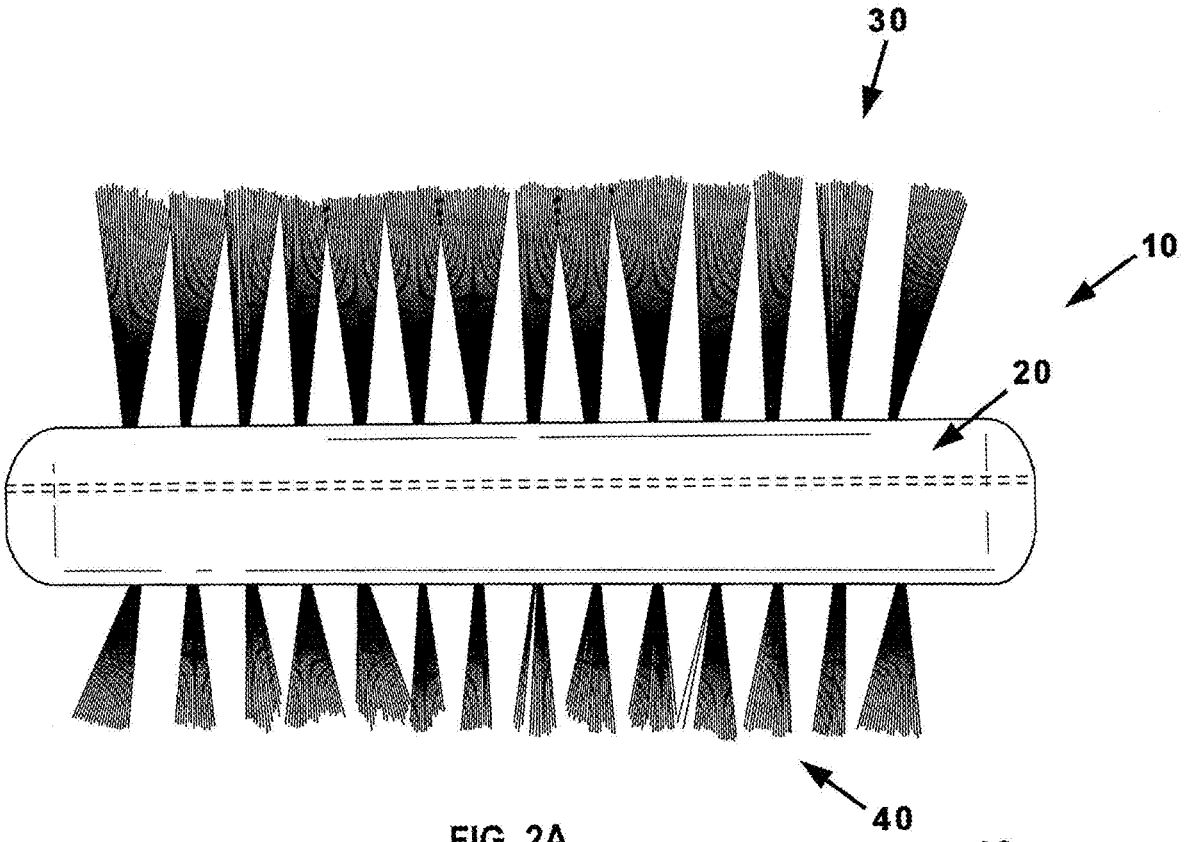
FIG. 2A is an isolated top view of the bar tapping tool removed from the uneven bars, illustrated with the long bristles in one configuration.
Figure 2B:
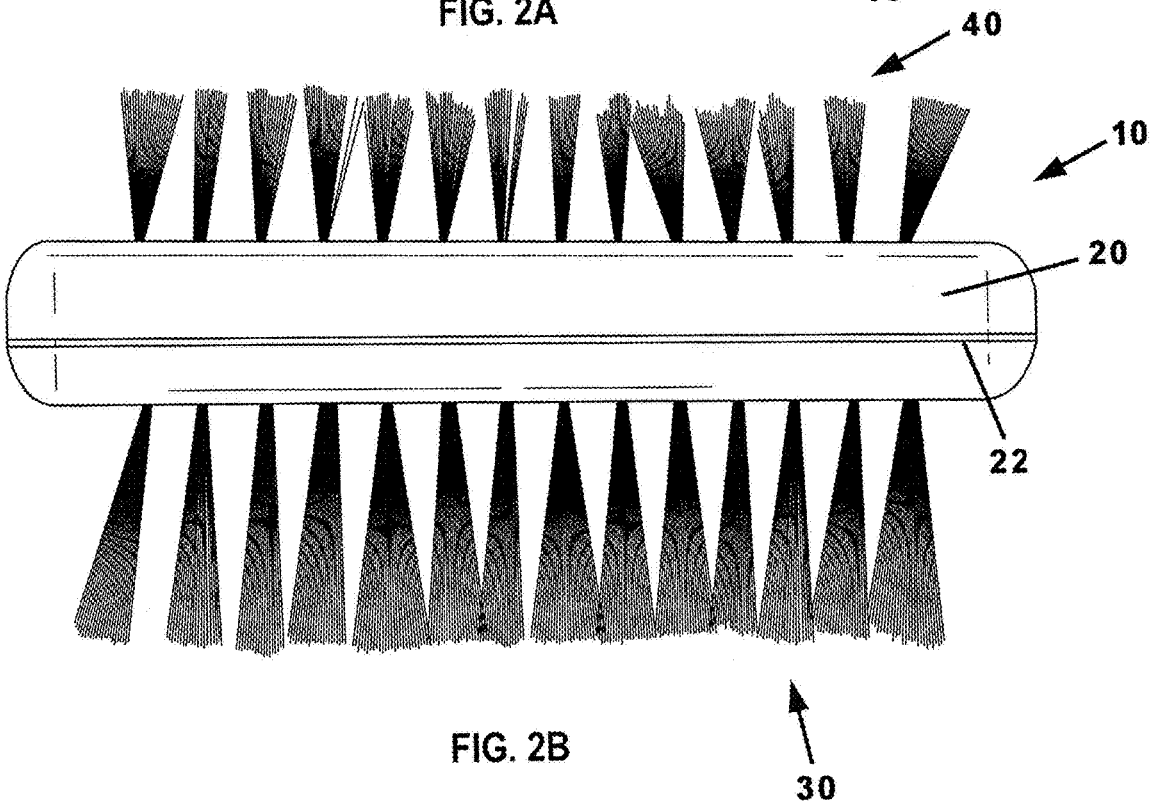
FIG. 2B is an isolated top view of the bar tapping tool removed from the uneven bars, illustrated with the long bristles in another configuration.
Figure 3:
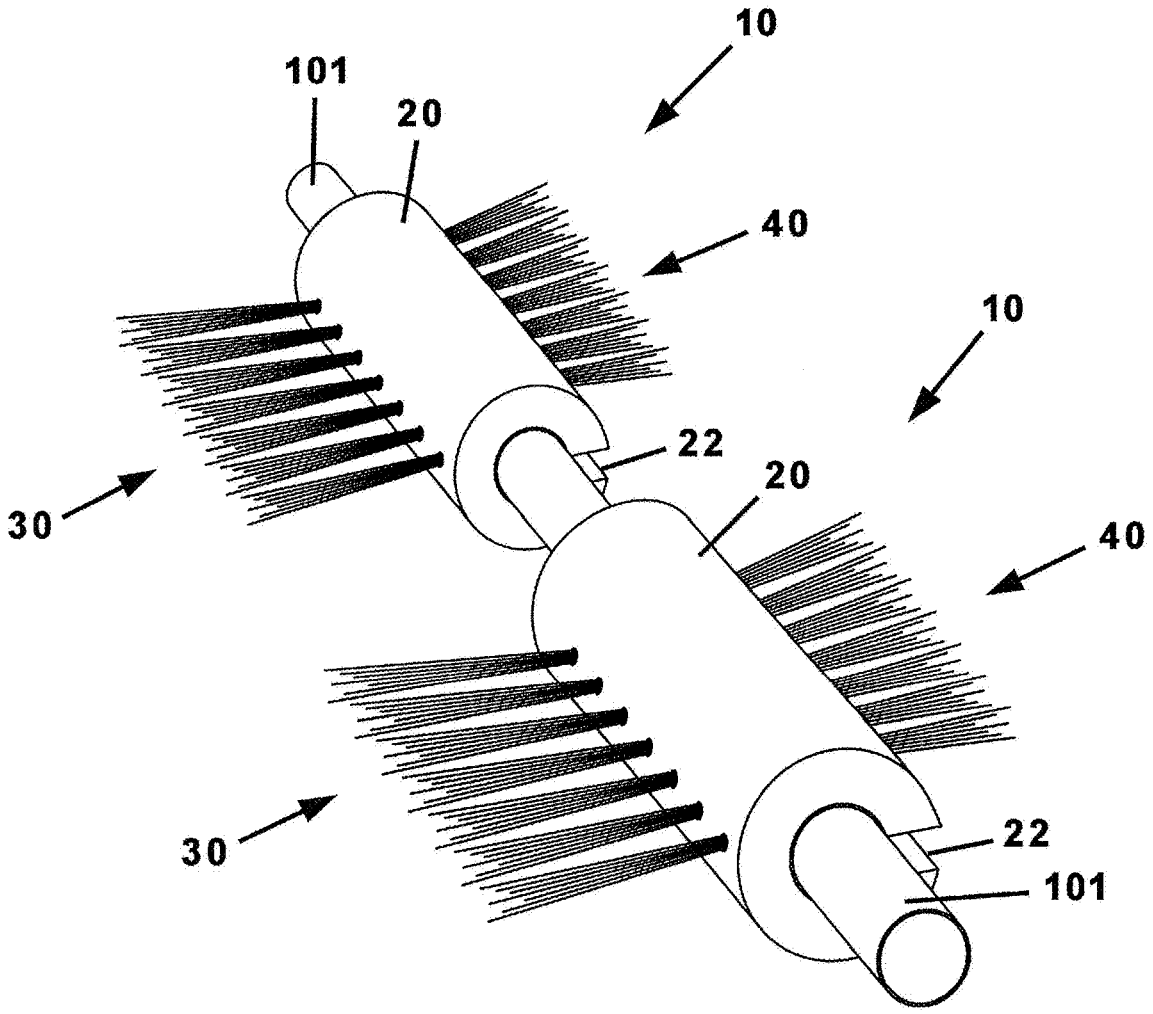
FIG. 3 is a perspective view of the bar tapping tool according to a preferred embodiment of the present invention.

A bar tapping tool according to a preferred embodiment of the present invention will now be described with reference to FIG. 1A to 3 of the accompanying drawings.

The bar tapping tool 10 includes a body 20 having a continuous sidewall 22 that is configured to be frictionally coupled to a lower bar 101 of an uneven bars apparatus 100. The uneven bars (also referred to as parallel bars) are two bars set apart at different heights, so that the gymnast can move from bar to bar. Preferably, one bar is more elevated than the other and one bar is reportedly displaced from the other bar. Namely, there is a lower bar 101 and an upper bar 102. Preferably, they are made of a steel frame and fiberglass with wood coating. The gymnasts must complete bar routines that were choreographed by her or by her coach. At the highest levels, these gymnastics routines may be choreographed to music. In an embodiment, the body 20 of the bar tapping tool can may have a cylindrical configuration having a complementary configuration to that of the lower bar 101. In a preferred embodiment, the body may be constructed of a flexible material such as foam, rubber, a spongy derivative, leather, or other soft material that would be padded and forgiving if contacted by the feet of the athlete. Preferably, the sidewall 22 defines an interior area having a diameter that is larger than a diameter of the lower bar 101 and may define a slot 22 extending between opposed ends thereof such that the body 20 may be opened slightly when frictionally applying it to the lower bar 101. In other words, the body 20 is flexible enough to open so as to receive the lower bar 101 into its interior area. Stated another way, the body 20 may be manipulated to crawl around an outer surface of the lower bar 101.

The bar tapping tool 10 includes a plurality of first bristles 30 each first bristle having a proximal end 31 coupled to a first side of the body 20 and a distal end 32 displaced from the body 20. In an embodiment, the plurality of first bristles 30 is spaced apart along the first side of the body 20 between opposed ends thereof. Importantly, each first bristle 30 has a uniform length that will be referred to as the "longer length bristles." In an embodiment, each first bristle 30 may have a length of about 4" to about 6". It is understood that the plurality of first bristles 30 is aligned linearly parallel to an imaginary longitudinal axis defined by the body 20 and by the lower bar 101 itself. Each bristle 30 may be laterally spaced apart from an adjacent bristle 30.

Similarly, the bar tapping tool 10 includes a plurality of second bristles 40 each second bristle having a proximal end 41 coupled to a second side of the body 20 and a distal end 42 displaced from the body 20. In an embodiment, the plurality of second bristles 40 is spaced apart along a second side of the body 20 between opposed ends thereof. Importantly, each second bristle 40 has a uniform length that will be referred to as the "shorter length bristles." In an embodiment, each second result 40 may have a length of about 1" to about 3". Further, the plurality of second bristles 40 may be aligned linearly and parallel to an imaginary longitudinal axis defined by the body 20 and by the lower bar 101 itself. Each bristle 40 may be laterally spaced apart from an adjacent bristle 40.

With further reference to the bristles, each first bristle 30 and each second bristle 40 may include a multitude of bundled bristles that are configured to fan out at respective distal ends. Further, the first side and second side of the body 20 are opposite one another such that the plurality of first bristles 30 are opposite the plurality of second bristles 40 and each of the plurality of first bristles 30 have a length that is about twice as long as the length of the plurality of second bristles 40.

In use the body 20 may be secured to a lower bar 101 such that the plurality of first bristles 30 are each facing in the direction of the upper bar 102. Then, when the athlete becomes more experienced and accustomed to "tapping" the plurality of first bristles 30, the body 20 may be removed, and swiveled or rotated 180° and resecured to the lower bar such that the plurality of second bristles 40 are each facing in the direction of the upper bar 102.

It is understood that while certain forms of this invention have been illustrated and described, it is not limited thereto except insofar as such limitations are included in the following claims and allowable functional equivalents thereof.

The invention claimed is:

1. A bar tapping tool mounted to an uneven bars gymnastics apparatus of a type having an upper bar displaced from a lower bar about which a gymnast moves and swings, said bar tapping tool, comprising:

a body having a generally cylindrical or tubular configuration that is constructed of a flexible and resilient material and which defines an interior area, said body defining a slot having an elongate configuration extending between opposed ends of said body and in communication with said interior area;

a plurality of first bristles mounted linearly along a first outer portion of said body each first bristle extending away from said first outer portion; and a plurality of second bristles mounted linearly along a second outer portion of said body each second bristle extending away from said second outer portion;

wherein said plurality of first bristles is rotationally displaced 180° from said plurality of second bristles;

wherein said plurality of first bristles each have a first uniform length and said plurality of second bristles each have a second uniform length that is shorter than said first uniform length.

2. The bar tapping tool as in claim 1, wherein said plurality of first bristles and said plurality of second bristles extend in opposite directions relative to one another.

3. The bar tapping tool as in claim 1, wherein:

said plurality of first bristles each includes a plurality of first bristle fibers that are coupled together at a point of attachment to said first outer portion of said body; and said plurality of second bristles each includes a plurality of second bristle fibers that are coupled together at a point of attachment to said second outer portion of said body.

4. The bar tapping tool has in claim 1, wherein:

said first uniform length is between about 4" and about 6"; and said second uniform length is between about 1" and about 3".

5. The bar tapping tool as in claim 1, wherein:

said plurality of first bristles are laterally spaced apart from one another and situated in a linear configuration extending between said opposed ends of said body; and said plurality of second bristles are laterally spaced apart from one another and situated in a linear configuration extending between said opposed ends of said body.

6. The bar tapping tool as in claim 1, wherein said body includes a left body member corresponding to a left foot of a user and a right body member laterally spaced apart from said left body member and corresponding to a right foot of the user.

7. The bar tapping tool as in claim 6, wherein said left body member and said right body member have an identical construction.

8. The bar tapping tool as in claim 1, wherein said interior area of said body is configured to allow rotation of said body about the lower bar.

9. The bar tapping tool as in claim 8, wherein:

said plurality of first bristles is oriented to extend in a direction facing the upper bar when the body is rotated about the lower bar to a first configuration; and said plurality of second bristles is oriented to extend in the direction facing the upper bar when the body is rotated about the lower bar to a second configuration.

10. The bar tapping tool as in claim 1, wherein said slot is configured to receive the lower bar into said interior area such that said body is rotatable about the lower bar when actuated.

11. A bar tapping tool mounted to an uneven bars gymnastics apparatus of a type having an upper bar displaced from a lower bar about which a gymnast moves and swings, said bar tapping tool, comprising:

a body having a generally cylindrical or tubular configuration that is constructed of a flexible and resilient material and which defines an interior area, said body defining a slot having an elongate configuration extending between opposed ends of said body and in communication with said interior area;

wherein said slot is configured to receive the lower bar into said interior area and said interior area of said body is configured to allow rotation of said body about the lower bar when rotationally manipulated by a user;

a plurality of first bristles mounted linearly along a first outer portion of said body each first bristle extending away from said first outer portion; and a plurality of second bristles mounted linearly along a second outer portion of said body each second bristle extending away from said second outer portion;

wherein said plurality of first bristles is rotationally displaced 180° from said plurality of second bristles;

wherein said plurality of first bristles each have a first uniform length and said plurality of second bristles each have a second uniform length that is shorter than said first uniform length.

12. The bar tapping tool as in claim 11, wherein:

said plurality of first bristles is oriented to extend in a direction toward the upper bar when the body is rotated about the lower bar to a first configuration; and said plurality of second bristles is oriented to extend in said direction toward the upper bar when the body is rotated about the lower bar to a second configuration.

13. The bar tapping tool as in claim 11, wherein said plurality of first bristles and said plurality of second bristles extend in opposite directions relative to one another.

14. The bar tapping tool as in claim 11, wherein:

said plurality of first bristles each includes a plurality of first bristle fibers that are coupled together at a point of attachment to said first outer portion of said body; and said plurality of second bristles each includes a plurality of second bristle fibers that are coupled together at a point of attachment to said second outer portion of said body.

15. The bar tapping tool has in claim 11, wherein:

said first uniform length is between about 4" and about 6"; and said second uniform length is between about 1" and about 3".

16. The bar tapping tool as in claim 11, wherein:

said plurality of first bristles are laterally spaced apart from one another and situated in a linear configuration extending between said opposed ends of said body; and said plurality of second bristles are laterally spaced apart from one another and situated in a linear configuration extending between said opposed ends of said body.

17. The bar tapping tool as in claim 11, wherein said body includes a left body member corresponding to a left foot of a user and a right body member laterally spaced apart from said left body member and corresponding to a right foot of the user.

* * * * *